US012421010B2

(12) United States Patent
Caron

(10) Patent No.: US 12,421,010 B2
(45) Date of Patent: Sep. 23, 2025

(54) RECEPTACLE FOR STORING AND PRESERVING A CARTRIDGE HAVING A NOZZLE FOR DISPENSING A POLYMERIZABLE RESIN

(71) Applicant: CRYSLA, Orleans (FR)

(72) Inventor: Christelle Caron, Gagny (FR)

(73) Assignee: CRYSLA, Orleans (FR)

( * ) Notice: Subject to any disclaimer, the term of this patent is extended or adjusted under 35 U.S.C. 154(b) by 0 days.

(21) Appl. No.: 18/717,556

(22) PCT Filed: Nov. 22, 2022

(86) PCT No.: PCT/EP2022/082758

§ 371 (c)(1),
(2) Date: Jun. 7, 2024

(87) PCT Pub. No.: WO2023/104502

PCT Pub. Date: Jun. 15, 2023

(65) Prior Publication Data

US 2025/0051079 A1 Feb. 13, 2025

(30) Foreign Application Priority Data

Dec. 10, 2021 (EP) ..... 21306749

(51) Int. Cl.
*B65D 81/20* (2006.01)
*B65D 25/10* (2006.01)

(52) U.S. Cl.
CPC ..... *B65D 81/2038* (2013.01); *B65D 25/106* (2013.01)

(58) Field of Classification Search
CPC ..... B65D 25/106; B65D 81/2015; B65D 81/2038

(Continued)

(56) References Cited

U.S. PATENT DOCUMENTS 5,195,427 A * 3/1993 Germano ..... B65B 31/047 206/524.8
7,967,163 B1 * 6/2011 Martin ..... B65D 25/54 215/11.4

(Continued)

FOREIGN PATENT DOCUMENTS

| | | | |
|---|---|---|---|
| DE | 19808643 | A1 | 9/1999 |
| WO | 2007038289 | A2 | 4/2007 |
| WO | 2016159796 | A1 | 10/2016 |

OTHER PUBLICATIONS

International Search Report for PCT/EP2022/082758, dated Mar. 13, 2023.

*Primary Examiner* — Luan K Bui
(74) *Attorney, Agent, or Firm* — Chrisman Gallo Tochtrop LLC

(57) ABSTRACT

The application relates to a receptacle for storing and preserving a reserve of polymerisable resin. The receptacle is a receptacle for storing and preserving at least one cartridge having a nozzle for dispensing a resin. The receptacle includes a rigid blind tube having an axial extension, which provides a cavity for receiving one such cartridge, and a head for depressurisation and leaktight closure of the tube, the head being removably mounted at an open end of the tube and the cartridge being inserted inside the tube and/or withdrawn from the tube via the open end.

9 Claims, 3 Drawing Sheets

Figure 1:
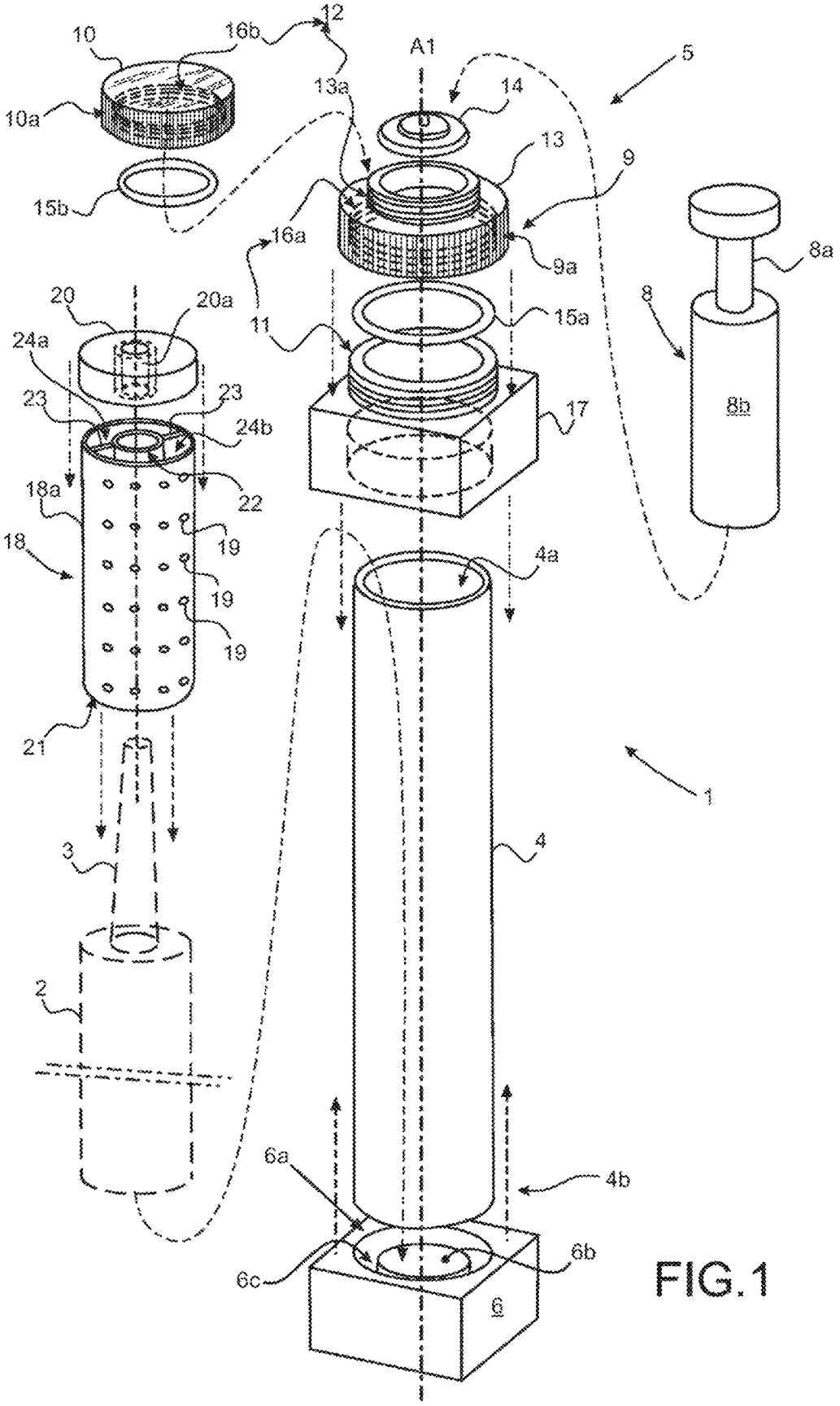

(58) Field of Classification Search
USPC ..... 206/493, 524.8
See application file for complete search history.

(56) References Cited

U.S. PATENT DOCUMENTS

| | | | | |
|---|---|---|---|---|
| 2007/0095713 | A1* | 5/2007 | Schooley | B65D 81/2015 206/524.8 |
| 2007/0163914 | A1 | 7/2007 | Gehring | |
| 2018/0016065 | A1* | 1/2018 | Ho | B65D 51/1683 |
| 2018/0222659 | A1* | 8/2018 | Plazarte | B65D 51/1683 |
| 2020/0095047 | A1* | 3/2020 | Bamonte | B65D 85/60 |

* cited by examiner

RECEPTACLE FOR STORING AND PRESERVING A CARTRIDGE HAVING A NOZZLE FOR DISPENSING A POLYMERIZABLE RESIN

CROSS-REFERENCE TO RELATED APPLICATIONS

This application is a national stage entry of PCT/EP2022/082758, filed on Nov. 22, 2022, that claims the benefit of European Application No. EP21306749.9, filed Dec. 10, 2021, the entire disclosures of which are hereby incorporated herein by reference.

TECHNICAL FIELD

The invention relates to the field of receptacles for contents that are particularly problematic to store, which receptacles are suitable for preventing the deterioration of said contents. The invention concerns such a receptacle specifically suitable for the storage and conservation of a reserve of polymerizable resin.

PRIOR ART

In various fields, it is routine practice to form beads of resin between two adjoining surfaces, such as a seal and/or join between the contiguous parts. Such resins notably originate from a polymer which is air- and/or moisture-polymerizable, or else are two-component resins originating from an epoxy monomer polymerizable via a curing agent.

To this end, it is routine practice to use a cartridge which forms a reservoir containing a polymer or containing an agent for crosslinking an epoxy monomer which are contained separately in respective cells of the reservoir. The cartridge is equipped with a nozzle for discharging the resin out of the cartridge from the reservoir, allowing a user of the cartridge to form the bead of resin between the adjoining surfaces.

Various techniques are used to discharge the resin out of the cartridge. For example, the one or more materials from which the resin originates are contained under pressure inside the reservoir. The nozzle is then provided with a valve for dispensing the resin from the cartridge. As another example, the cartridge is in the form of a piston for delivering the resin from the reservoir to the nozzle. The bottom of the cartridge is axially movable inside the body of the cartridge, forming a resin-thrusting member that can be manoeuvered by a user, usually by means of a specific tool.

Such cartridges are easy for a user to use but have the drawback of ventilation of the nozzle, with the consequence that the nozzle becomes blocked by the polymerized resin that it contains. When the bead is being formed, the polymerized resin at the outlet of the nozzle forces the user to cut off the blocked end of the nozzle to allow resin to be discharged out of the cartridge again.

Furthermore, one problem is that a cartridge is often only partially used during an operation of forming a bead. Consequently, a residue of resin remains present in the reservoir. The cartridge is then conserved by the operator with a view to being used later until the resin it contains is depleted.

However, the period of time between successive uses of the same cartridge can be very long, by way of indication several weeks to several months depending on the resin used and/or depending on the ambient conservation temperature of the cartridge. The result is that a depleted cartridge is often thrown away owing to not being used for a long period and/or being conserved in unfavorable storage conditions.

SUMMARY OF THE INVENTION

The invention relates to a receptacle for storing and conserving a reserve of polymerizable resin.

The invention more specifically concerns such a receptacle, the arrangement of which is suitable for the storage of at least one cartridge having a nozzle for dispensing a polymerizable resin. Within the context of the invention, it will be understood that such a cartridge commonly comprises an elongate body mainly forming a reservoir provided with a nozzle for polymerizing and dispensing the resin from the cartridge. The resin may be either of the type originating from an air- and/or moisture-polymerizable polymer contained in the reservoir or of the two-component resin type originating from an epoxy monomer cured by a crosslinking agent which are contained in the separate cells of the reservoir.

The main aim of the invention is to overcome the aforementioned problem of adequate conservation of the one or more materials contained inside such a cartridge, for a potentially long period of time. A notable aim of the invention is to preserve the cartridge with respect to alteration of the physicochemical characteristics of the one or more materials it contains, for an optimized period of time. It will be understood here that the invention aims to preserve not just a cartridge of partially used resin-containing a residue of resin after its reservoir was partially emptied beforehand—but also a new cartridge conserved in the receptacle pending use.

Another aim of the invention is to propose a solution for this that performs well and is ergonomic for a user, by facilitating its implementation so as to allow them alternatively to store the cartridge in an ambient medium favorable for its conservation and, conversely, to remove it from this medium in order to be able to easily use the cartridge, potentially repeatedly.

Another aim of the invention is to seek such a solution having reduced costs, both with regard to its structure and the costs for obtaining it and also with regard to the constraints linked to logistic transport and/or storage between a production site and a site for delivering the receptacle to a user. Specifically, such cost constraints force designers to exert additional search efforts at the risk of delivering solutions that potentially perform well but would be economically prohibitive on the market.

To do this, the invention proposes overall to conserve the cartridge inside a receptacle comprising a blind rigid tube, one of the ends of which is open, forming a passage for introducing the cartridge into the tube and removing the cartridge from the tube, and the blind other end of which forms a leaktight closure bottom of the tube. The receptacle is equipped with a head mounted detachably at the open end of the tube. The head is configured to selectively generate a negative pressure inside the tube receiving a cartridge, and to hermetically close off the receptacle after negative pressure has been generated in the tube or without generation of negative pressure in the tube if there is no cartridge.

The blind end of the tube may be hermetically closed by a base sealed around the bottom of the tube, the base having a centering member for axially centering the cartridge inside the tube (4).

The head is equipped with a depressurization member for depressurizing the tube, which is hermetically mounted detachably at the open end of the tube, with a detachable cap for hermetic closure of the receptacle—which is itself mounted detachably on the depressurization member—and with a detachable vacuum pump which interacts with the depressurization member after the cap is removed. The vacuum pump thus installed in interaction with the depressurization member can then be manoeuvered by the user to extract the air contained inside the tube and evacuate it into the ambient air, which is to say out of the tube toward the outside of the receptacle.

The depressurization member has a non-return valve which is naturally kept in a closed position and which is placed in an open position toward the outside of the receptacle via the vacuum pump manoeuvered by the user. The valve is accommodated inside a leaktight assembly ring of the depressurization member at the open end of the tube.

The ring is notably provided with a member for reversible assembly with the open end of the tube, such as by screwing or by elastic push-fitting for example. The ring is mounted leaktightly at the open end of the tube, via a seal which may be integrated in the ring or be fitted interposed between the ring and the open end of the tube. The vacuum pump is positioned so as to press against the valve via the ring, by push-fitting and guidance of the end of the vacuum pump introduced into the ring via its open end, which faces toward the outside of the receptacle.

The ring is potentially mounted detachably directly at the end of the tube. However, it is preferred to avoid degradation of the tube owing to repeated removal and mounting of the head on the tube each time a cartridge is introduced inside the tube. To this end, the tube is provided with a body sealed around the tube at its open end, via which the ring is mounted detachably at the open end of the tube. A seal is interposed between the ring and said body, by being secured to the ring or said body, or else by being independent or in other words separate from the ring and said body to make it easier to replace it in the event of wear.

The cap is provided with a member for reversible assembly with the depressurization member, such as by screwing or by elastic push-fitting for example. A seal is interposed between the cap and the depressurization member, by being secured to the cap or the ring, or else by being independent or in other words separate from the cap and the ring to make it easier to replace it in the event of wear.

The tube is hermetically closed at its blind end by a base sealed around the tube. The base has a centering member for centering the cartridge inside the tube, a depressurization chamber being formed between the wall of the tube and the cartridge that it accommodates centered inside the tube.

The particular—but frequent—case of the cartridge being of the type in the form of a piston will be noted at this juncture of the description. In this case, potential partial emptying of the reservoir by delivery of the resin via the movable bottom of the cartridge, as targeted above, is taken into account. Then, under the effect of generating a negative pressure in the tube, the bottom of the cartridge tends to be displaced inside the reservoir into an initial position, which is to say toward the blind bottom of the tube closed by the cartridge centering member.

Such a situation tends to allow resin to potentially escape from the reservoir via its bottom under the effect of generating a negative pressure in the tube. To overcome such a risk, the centering member is moreover in the form of a member for axial abutment of the movable bottom of the reservoir in said initial position, preventing the escape of a residue of resin from the reservoir of the cartridge via its bottom after a negative pressure is generated in the tube.

Thus, synthetically, said centering member constitutes both:

- a centering member for centering any cartridge inside the tube, and
- in the case of a piston cartridge of the type mentioned above, a member for axial blocking of the movable bottom of the reservoir of the piston cartridge when a negative pressure is generated in the tube, the movable bottom of the reservoir bearing against an axial stop of the centering member that penetrates the interior of the tube at its bottom to obstruct the escape of resin from the cartridge.

The depressurization chamber is a volume just enough to allow air to circulate from the interior of the tube to the contributing depressurization member of the head. A significant increase in the size of the tube and the vacuum pump is thus avoided. Moreover, a user can grip and handle the receptacle more easily, the user being able to easily grasp the rigid tube in one hand and hold it firmly for alternative installations of the components of the head in succession on the tube.

The receptacle is also fitted with a laterally perforated cover axially accommodating, in its interior volume, a sleeve for receiving the nozzle belonging to the cartridge. The cover for the one part is provided with a hood sealed at its end facing toward the depressurization member and for the other part has a partition for closing its other end facing toward the bottom of the tube.

The hood is provided with a bushing for centering the end of the nozzle. The centering bushing is push-fitted into the end of the sleeve facing toward the head and is open at each of its axial ends, allowing the end of the nozzle to potentially emerge from the cover, notably if the cartridge is new- or in other words not yet used- and the nozzle of which is closed prior to possibly cutting off its end after the cartridge is used.

The axial ends of the sleeve are each open and lead into the inside of the tube respectively on one side via said centering bushing and on the other side via a passage formed through said partition of the cover, through which the nozzle is introduced into the cover when said cover is being placed around the nozzle by the user. The sleeve and the centering bushing interact with said centering member formed at the bottom of the tube, by supporting the retention of the cartridge in an axially centered position inside the tube.

An interior volume of the cover formed between its perforated wall and the sleeve delimits at least one compartment for receiving at least one agent for treating the air contained inside the tube.

Such a treatment agent is notably at least one moisture absorbing agent for dehumidifying the air remaining inside the tube after a negative pressure is generated in it. Alternatively, other air treatment agents may be used, such as for example a deodorizing agent limiting the unpleasantness of the odor of the resin and/or a purifying agent for chemically purifying the air evacuated from the receptacle after a negative pressure is generated in the tube.

The one or more said treatment agents may be contained in the same compartment or in respective separate components of the cover. The one or more said treatment agents are permeable to air by being for example conditioned in the form of granules. When the tube is being depressurized, the air contained inside the cover circulates through the one or more said treatment agents and is then evacuated to the depressurization chamber via the perforations in the cover. The air contained in the depressurization chamber then at least partially circulates to the depressurization member and more specifically through the valve placed in an open position, and is evacuated toward the outside of the receptacle via the vacuum pump.

The vacuum pump is smaller than the interior recess of the tube. If there is no cartridge inside the receptacle—while the cartridge is being used or during logistic transport and/or storage of the receptacle—the vacuum pump can therefore be stowed inside the tube. All of the components of the receptacle are joined together into a whole, limiting its size and thus facilitating the logistic packaging, transport and storage of the receptacle.

The structure and use of the receptacle are simplified. The user can introduce the cartridge into the tube after temporary removal of the head mounted detachably at the open end of the tube—via the depressurization member—and then reinstall the head at the open end of the tube or at the very least the depressurization member via which a negative pressure is generated in the tube. The cap for hermetic closure of the receptacle is temporarily removed by the user to allow them to access the depressurization member and place the vacuum pump in interaction with the valve to generate a negative pressure in the tube.

It will be understood that the cap can be removed by the user indiscriminately, either before or after the hermetic assembly between the depressurization member and the open end of the tube. It will also be understood that the valve is naturally kept in a closed position by being manoeuverable into the open position toward the outside of the receptacle under the effect of the negative pressure generated by the vacuum pump pressed temporarily against the valve and manoeuvered by the user.

When a negative pressure has been generated in the tube, the user removes the pump, with the effect of naturally placing the valve in a closed position, thus keeping the tube at negative pressure. The user then hermetically closes off the receptacle by mounting the cap on the depressurization member held assembled with the tube. It will be noted that the cap also forms a valve protecting member, preventing the valve from being adversely affected when the receptacle is being handled or transported.

To remove the cartridge from the receptacle, the user removes the head from the tube by removing the depressurization member mounted at the open end of the tube. The tube is then pressurized with ambient air and the cartridge can be easily extracted from the tube by the user via its open end.

The depressurization of the tube around the cartridge—the reservoir and the nozzle accommodated inside the sleeve surrounded by one or more said air treatment agents—forms an ambient medium for storing the cartridge that is favorable to conserving it effectively—including potentially over the long term—without stopping the user being able to introduce, remove and reintroduce the cartridge in and from the receptacle easily and repeatedly until the reserve of resin it contains is depleted.

It will be noted that, since the cartridge is stored inside the receptacle, said head of the receptacle is kept secured to the tube. The vacuum pump may be provided with a member for reversible attachment to the tube at its outer wall. Since the receptacle has a limited size, it can be easily stowed in an environment promoting the conservation of the resin contained in the cartridge, such as for example a refrigerated environment.

It will also be noted that the receptacle may have a single tube, or multiple adjacent tubes parallel to one another, for storing multiple cartridges respectively installed in the tubes. The one or more tubes are advantageously transparent to make the one or more cartridges installed inside the one or more tubes visible. This allows a user to identify the type of the one or more cartridges contained inside the receptacle on the basis of the nature of the resin they contain.

With regard to the above text, the invention relates to a receptacle for storing and conserving a reserve of polymerizable resin. According to the invention, the receptacle is a receptacle for storing and conserving at least one cartridge having a nozzle for dispensing a resin.

The receptacle comprises at least:

- at least one blind rigid tube of axial extent forming a receiving portion for receiving one said cartridge. One of the axial ends of the tube is open, forming a passage for introducing the cartridge into the tube and conversely removing the cartridge from the tube. The other axial end of the tube is blind, forming a leaktight closure bottom of the tube.
- a head for depressurizing and leaktight closure of the tube, which head is mounted detachably at the open end of the tube.

It is specified here that the receptacle may have a single tube or multiple adjacent, parallel tubes for respectively storing multiple cartridges respectively—or in other words individually—installed multiply in the tubes.

According to one embodiment, the head comprises:

- a depressurization member for depressurizing the tube provided with a first mounting member for leaktight mounting of the head at the open end of the tube,
- a cap for leaktight closure of the receptacle provided with a second mounting member for leaktight mounting on the depressurization member. The cap is mounted detachably on the depressurization member between an active state in which the cap mounted on the depressurization member hermetically closes off the receptacle and an inactive state in which the removed cap allows a detachable vacuum pump belonging to the head to interact with the depressurization member.

According to one embodiment, the first leaktight-mounting member has a ring which forms the depressurization member and a first fixing member for reversible fixing of the ring at the open end of the tube via a first seal. The depressurization member has a valve accommodated inside the ring, the valve being naturally held in a closed position and being manoeuverable into an open position via the vacuum pump applied against the valve. It will be understood here that a user of the receptacle can press the vacuum pump against the valve and manoeuver it.

Furthermore, the second mounting member for leaktight mounting of the cap on the depressurization member is formed by a second fixing member for reversible fixing of the cap at the open end of the ring that faces toward the outside of the receptacle via a second seal.

According to one embodiment, the open end of the tube is provided with a recessed body sealed around the tube, on which recessed body the head is mounted detachably at the open end of the tube.

According to one embodiment, the blind end of the tube is hermetically closed by a base sealed around the bottom of the tube. The base has a centering member for axially centering the cartridge inside the tube. Said centering member is for example advantageously in the form of a member for push-fitting of the cartridge via its base.

More specifically, the centering member is in the form of a bowl axially accommodating an abutment member against which a possible movable bottom of a piston cartridge is blocked after potentially too great a negative pressure is generated in the tube. The peripheral wall of the tube, at its blind end, is sealed at the peripheral wall of the bowl.

According to one embodiment, a depressurization chamber for depressurizing the tube is formed around the cartridge installed inside the tube, between the wall of the tube and the cartridge held centered inside the tube at least via said centering member.

According to one embodiment, the receptacle is equipped with a cover for receiving the nozzle of the cartridge accommodated inside the tube, the cover being installed around the nozzle. It will be understood here that the cover may be installed around the nozzle by a user of the receptacle, either before or after the cartridge is introduced into the tube after the head is removed.

According to one embodiment, the cover axially accommodates a sleeve for receiving the nozzle which opens onto the interior volume of the tube, through a partition for closing the cover at its end facing toward the blind end of the tube, and through a hood which is hermetically sealed on the cover at its end facing toward the open end of the tube and which is provided with a centering bushing for axially centering the nozzle inside the cover.

According to one embodiment, the cover comprises, along its axial extent, a perforated peripheral wall, the perforations of which form passages for air between an interior volume of the cover surrounding the sleeve and the outside of the cover toward the depressurization chamber. Said interior volume of the cover forms at least one compartment for receiving at least one agent for treating the air contained inside the tube, said at least one air treatment agent being conditioned to be permeable to the air.

Multiple compartments may be formed inside the cover, for example by being separated from one another by flanges for fixing the sleeve to the perforated peripheral wall of the cap. Said at least one air treatment agent is notably at least one moisture absorbing agent and alternatively a deodorizing agent and/or a purifying agent that may also be accommodated inside the one or more compartments of the cover, in addition to the moisture absorbing agent.

The deodorizing agent and/or the purifying agent may be installed inside respective compartments of the cover that are separate from the compartment accommodating the moisture absorbing agent. According to one variant, the deodorizing agent and/or the purifying agent may be installed in the same compartment that also receives the moisture absorbing agent with which they are mixed, notably if said air treatment agents are conditioned in the form of a granular material.

PRESENTATION OF THE FIGURES

The invention will be better understood on reading the following detailed description of an exemplary embodiment of the invention, in relation to the following figures on the appended plates, in which:

FIG. 1: FIG. 1 is an exploded perspective illustration of a receptacle in accordance with the invention, designed to store and conserve a cartridge having a nozzle for dispensing a polymerizable resin.

Figure 2:
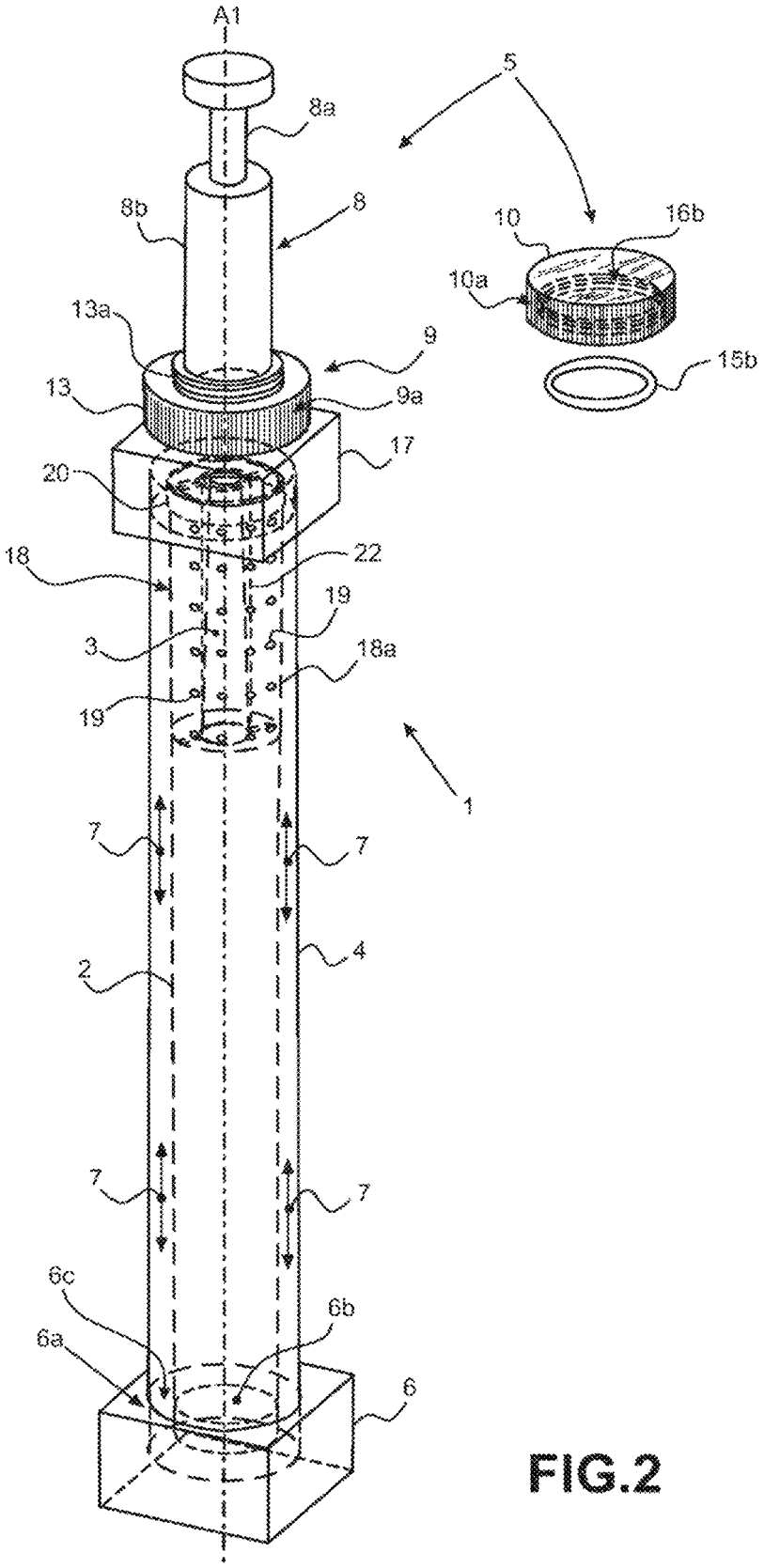

FIG. 2: FIG. 2 is an assembled perspective illustration of the receptacle illustrated in FIG. 1 in a first use configuration. In FIG. 2, the cartridge is accommodated inside a tube in which a negative pressure is generated via a depressurization member which has a head belonging to the tube and interacts with a vacuum pump belonging to the head, the head being mounted on the tube in a first operating state.

Figure 3:
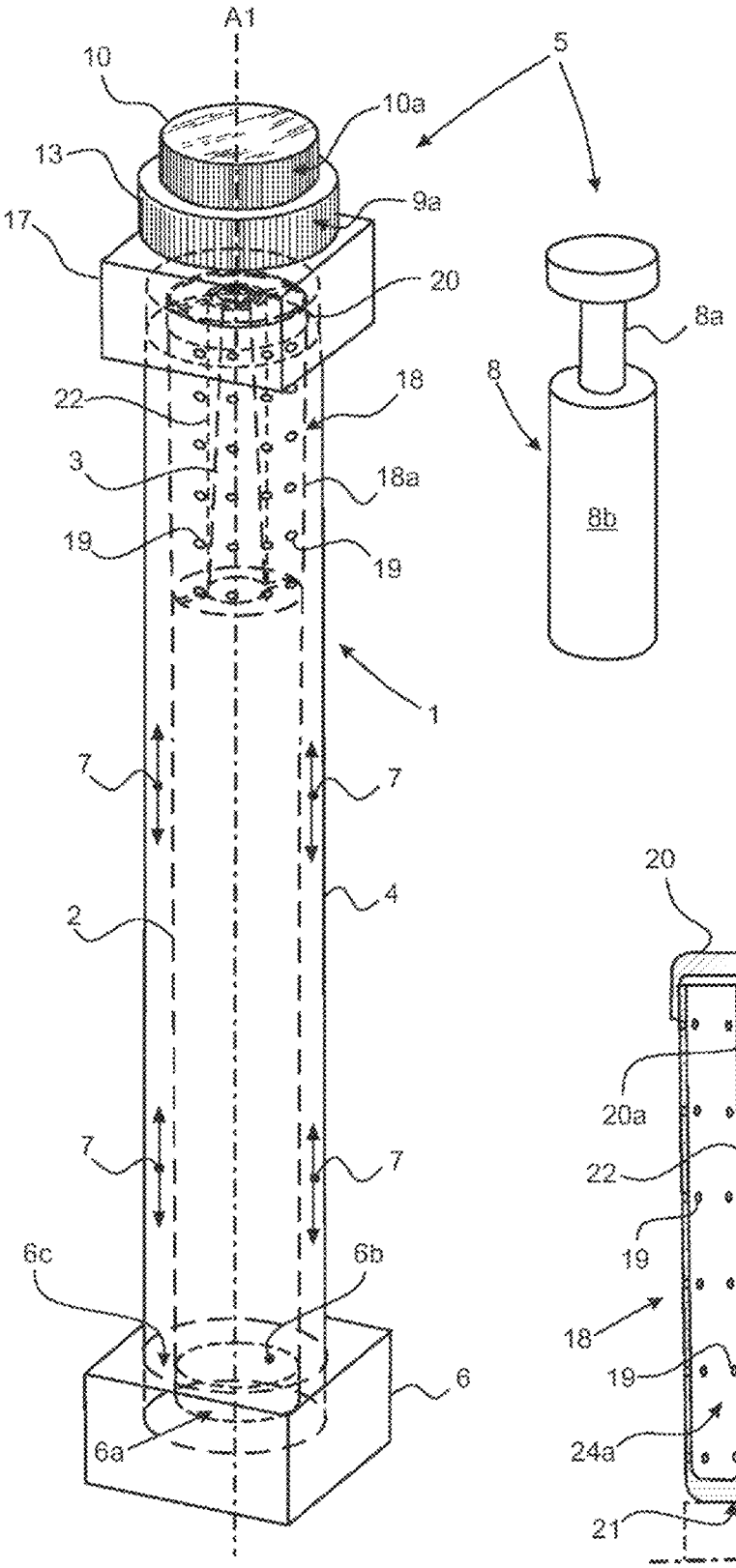

FIG. 3: FIG. 3 is an assembled perspective illustration of the receptacle illustrated in FIG. 1 and FIG. 2 in a second use configuration. In FIG. 3, the cartridge is accommodated inside the tube and the receptacle is hermetically closed by a cap of the head mounted on the tube in a second operating state.

Figure 4:
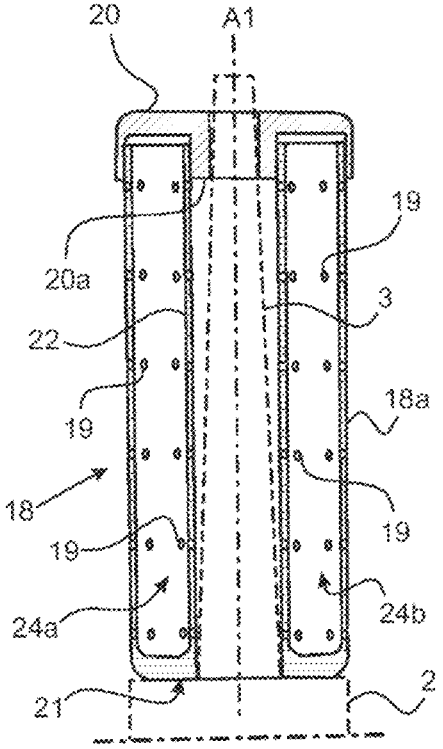

FIG. 4: FIG. 4 is an illustration, in axial section, of a perforated cover belonging to the receptacle. Said cover is intended to be accommodated inside said tube and has a sleeve through which extends the nozzle of a cartridge installed inside the receptacle. Said cover forms, around the sleeve, at least one compartment receiving at least one agent for treating the air contained inside the tube.

DETAILED DESCRIPTION

The figures and their non-limiting detailed description set out the invention according to particular modes which do not restrict the scope of the invention. The figures and their detailed description may serve to better comprehend and define the invention, if required in relation to the general description that has just been given. Furthermore, to avoid overloading the figures and thus make them easier to read, the reference numbers allocated to the terms and/or concepts used to describe the invention and indicated in any of the figures may be given in the description of any other figure without implying they are present in all of the figures.

In FIGS. 1 to 3, a receptacle 1 for storing and conserving a cartridge 2 having a nozzle 3 for dispensing a resin mainly has a rigid tube 4 of axial extent A1 and a head 5 which is mounted detachably on the tube 4 at one of its ends 4*a*, depending on the alternative differentiated operating states of the head 5 on the basis of selective utilization of various members of which it is composed.

The tube 4 forms a casing for receiving the cartridge 2. The tube 4 is preferably transparent to make the presence and/or absence of the cartridge 2 inside the tube 4 and its typology, depending on the type of resin it contains, visible through the wall of the tube 4. The tube 4 is a blind tube 4 having, along its axial extent, an open end 4*a* via which the cartridge 2 can be introduced into the tube 4. The other axial end of the tube 4 is a blind end 4*b* which forms a leaktight closure bottom of the tube 4.

The blind end 4*b* of the tube 4 is closed by a base 6 which is hermetically sealed around the tube 4 at its blind end 4*b*. The base 6 has a centering member 6*a* for axially centering the cartridge 2 inside the tube 4. The cross section of the tube 4 is slightly larger than that of the body of the cartridge 2, and this forms, between them, a depressurization chamber 7 extending axially between the wall of the tube 4 and the cartridge 2.

The centering member 6*a* is in the form of a bowl 6*c* axially A1 accommodating an abutment member 6*b*. The wall of axial extent of the tube 4 is interposed between the wall of the base 6 delimiting the bowl 6*c* and the centering member 6*a* for centering the cartridge 2. If too great a negative pressure is generated in the tube 4 accommodating a cartridge 2 of the piston cartridge type, the movable bottom of the cartridge 2 is blocked by being applied against the abutment member 6*b* in order to prevent escape of the resin from the reservoir of the cartridge 2.

In various alternative configurations and uses of the head 5, the head 5 is selectively exploited:

- either by removing the head 5 into an inactive state allowing the cartridge 2 to be introduced into the tube 4 and/or removed from the tube 4 via its open end 4*a*, as illustrated in FIG. 1, or in a first active state of the head 5, in which the head 5 is utilized to generate a negative pressure in the interior volume of the tube 4 accommodating the cartridge 2, as shown in FIG. 2, or in a second active state of the head 5, in which the head 5 is utilized to hermetically close the receptacle 1 and more specifically the tube 4 at its open end 4*a*, as shown in FIG. 3.

It is specified here that the head 5 may be placed in the second active state in the presence or absence of a cartridge 2 inside the tube 4:

in the presence of a cartridge 2 inside the tube 4 and after depressurization of the tube 4 as illustrated in FIG. 2, the head 5 is placed in the second active state to effectively conserve the negative pressure inside the tube 4 generated beforehand and to protect a participating valve 14 of a depressurization member 9, for depressurizing the tube 4, of the head 5, in the absence of a cartridge 2 inside the tube 4, the head 5 is placed in the first active state to limit the size of the receptacle 1. A vacuum pump 8 belonging to the head 5 is then stowed inside the tube 4, thereby facilitating the packaging of the receptacle 1 logistically when it is being transported and stored pending delivery to a user, and thereby making it possible to avoid losing the vacuum pump 8 while the cartridge 2, notably, is being used.

It will also be noted that, in the presence of a cartridge 2 inside the tube 4, the vacuum pump 8 can be easily placed in a position on the wall of the tube 4 retained to its outer face, via a reversible-attachment member of simple structure such as at least one elastic ring, or via adhesive tapes or hook-and-loop tapes (commonly denoted "velcro tape") respectively fixed to the tube 4 and to the vacuum pump 8.

The head 5 is mainly composed of said depressurization member 9 for depressurizing the tube 4, with a cap 10 for leaktight closure of the receptacle 1, and with the vacuum pump 8. The depressurization member 9 is axially mounted detachably at the open end 4*a* of the tube 4 via a first mounting member 11 for leaktight mounting of the head 5 at the open end 4*a* of the tube 4. The cap 10 is axially mounted detachably on the depressurization member 9 via a second leaktight-mounting member 12. The vacuum pump 8 is selectively installed on the depressurization member 9 by the user, as a substitute for the cap 10.

In FIG. 1, the depressurization member 9 has a ring 13 accommodating said valve 14 which is naturally held in a closed position. The ring 13 constitutes said first mounting member 11, being fitted with a first seal 15*a* and a first fixing member 16*a* for reversible fixing of the depressurization member 9 at the open end of the tube 4, such as by screwing in the example illustrated.

In the example illustrated, the depressurization member 9 is mounted on an axially A1 recessed body 17 which is hermetically sealed around the tube 4 at its open end 4*a*, as illustrated in FIGS. 1 to 3.

In FIGS. 1 and 2, said second mounting member 12 for mounting the cap 10 on the depressurization member 9 has a second seal 15*b* and a second fixing member 16*b* for reversible fixing of the cap 10, such as by screwing the cap 10 around a threaded bushing 13*a* formed at the open end of the ring 13 facing toward the outside of the receptacle 1.

In FIGS. 1 to 3, the cap 10 and the ring 13 each have, around their periphery, gripping reliefs—respectively 10*a* and 9*a*—via which the user can easily handle the cap 10 and the ring 13, without having to use a tool to rotate them. Such reliefs 10*a*, 9*a* are for example formed by axial projections as illustrated, or by knurling.

Furthermore, in FIGS. 1 to 3, the receptacle 1 is equipped with a cover 18 for receiving the nozzle 3 of the cartridge 2 accommodated inside the tube 4. The cover 18—shown on its own in FIG. 4—is installed by the user around the nozzle 3, either before or after the cartridge 2 is introduced into the tube 4.

The cover 18 has a lateral peripheral wall 18*a* of axial extent, which is provided with perforations 19 distributed across it, only some of these perforations 19 being provided with references so as to not overburden the figures.

The cover 18 is provided with a hood 20 for closing its end facing toward the open end 4*a* of the tube 4, and with a partition 21 in its bottom, this partition facing toward the blind bottom 4*b* of the tube 4. The hood 20 is sealed at the outer face of the peripheral wall 18*a* of the cover 18 and has a centering bushing 20*a* for centering the nozzle 3 inside the cover 18 in a position centered inside the tube 4. According to the example illustrated, the hood 20 is in one piece, advantageously being formed by injection molding a plastics material or by stamping a metal material via a stamp.

According to an embodiment variant which is not illustrated, the centering bushing 20*a* for centering the nozzle 3 may be utilized to interact with a member for blocking the nozzle 3 of which the end is cut off. The axial position of said blocking member inside the centering bushing 20*a* is advantageously adjustable by the user to make it come to bear at the tip of the nozzle 3, notably after the nozzle has been cut. Such a blocking member may for example be formed by a set screw screwed into the centering bushing 20*a* or by example be formed by a pin tightly mounted slidingly inside the centering bushing 20*a*.

FIG. 4 more particularly shows that a sleeve 22 open at each of its axial A1 ends, forming a receiving portion for receiving the nozzle 3, is integrated axially in the cover 18. The sleeve 22 extends axially A1 between the hood 20 and the partition 21 for closing the cover 18 at its bottom, the sleeve 22 leading out through said partition 21 and being apllied against the horizontal face of the body of the cartridge 2, together with the partition 21 for closing the bottom of the cover 18. The centering bushing 20*a* is push-fitted into the sleeve 22, it being possible for the end of the nozzle 3, if appropriate, to emerge from the hood 20, notably in the case of a new cartridge.

The peripheral wall 18*a* of the cover 18 surrounds the sleeve 22 at a distance, the sleeve being integrated in the peripheral wall of the cover 18 via fixing flanges 23, shown in FIG. 1. The separation volume between the peripheral wall 18*a* of the cover 18 and the sleeve 22 forms, between them, compartments 24*a*, 24*b* for receiving at least one agent for treating the air contained inside the tube 4 and conditioned so as to be permeable to air, including notably a moisture absorbing agent via which the moisture is removed from any remaining air that might be present inside the tube 4 after the tube has been depressurized.

Said compartments 24*a*, 24*b* are in fluidic communication with the depressurization chamber 7 via the perforations 19 formed through the peripheral wall 18*a* of the cover 18. Thereafter, generation of a negative pressure in the tube 4 via the depressurization member 9 placed in an active position by interaction with the vacuum pump 8 manoeuvered by the user causes evacuation of the air contained in the cover 18 passing through said at least one treatment agent and escaping out of the cover 18 toward the depressurization chamber 7. The air present in the depressurization chamber 7 is then at least partially evacuated out of the tube 4, circulating toward the vacuum pump 8 through the valve 14 placed in an open position to be evacuated out of the receptacle 1.

More specifically in FIGS. 1 and 2, the cap 10 initially mounted on the depressurization member 9 to hermetically close the receptacle 1 is removed by the user to allow the vacuum pump 8 and the depressurization member 9 to interact.

The vacuum pump 8 is a conventional piston pump of simple structure, which has a bushing 8*b* via which the vacuum pump 8 is push-fitted inside the cutout of the ring 13—by being applied against the valve 14—and a piston 8*a* for manoeuvering the vacuum pump 8. The introduction and the pressing of the end of the bushing 8*b* against the valve 14 by the user, and then the manoeuvering of the piston 8*a* that they carry out, cause air contained in the depressurization chamber 7 to be extracted by suction, placing the valve 14 in the open position and the air to be evacuated out of the tube 4, which air escapes into the ambient air outside the receptacle 1 via the vacuum pump 8.

Then, the tube 4 being depressurized, the user removes the vacuum pump 8, having the effect of placing the valve 14 naturally in a closed position, preventing air from entering the interior of the tube 4. To ensure hermetic closure of the tube 4, the user then installs the cap 10 on the ring 13 of the depressurization member 9 as illustrated in FIG. 3.

The receptacle 1 makes it possible to store the cartridge 2 inside the tube 4 in an ambient environment favorable for its conservation. The receptacle 1 is hermetically closed off at each of its ends respectively via the cap 10 and its blind bottom, said ambient environment thus formed inside the tube 4 being depressurized and the moisture being removed therefrom. More particularly, a said treatment agent contained inside the cover 18 is used to remove the moisture from a residue of air lingering inside the tube 4 after it has been depressurized.

The receptacle 1 is obtained at low cost, such as preferably by injection molding most of its components, notably the tube 4, the recessed body 17 and the base 6 which are mounted by sealing around the ends of the tube 4 that are associated with them, and the participating members of the head 5—cap 10, ring 13, valve 14, seals 15*a*, 15*b* and vacuum pump 8, and also the cover 18 in which the sleeve 22 and the partition 21 for closing its bottom are integrated by injection molding and which is provided with the hood 20 sealed on the cover 18.

The receptacle 1 is easy to use, since the tube 4 can be tightly held manually by the user to place the head 5 in the various operating configurations.

The size and arrangement of the receptacle 1 make it possible to limit the logistic costs linked with its packaging, its transport and/or its storage. The head 5 is kept housed on the receptacle 1 except for the vacuum pump 8, which can then be stowed inside the tube 4 in the absence of the cartridge 2 or be attached to the tube 4 in the presence of a cartridge inside the tube 4.

It should be noted that the arrangement of the receptacle 1 forms in itself a device for storing and conserving the cartridge 2 having a nozzle 3 so as to preserve its contents, using the tube 4 and the head 5 which is permanently held on the tube 4 selectively in whole or in part depending on the various steps of using the receptacle 1.

The size of the receptacle 1 is reduced to the best possible extent-notably owing to the arrangement of the head 5 allowing it to be used in various configurations on the basis of the alternative installation on the depressurization member 9 either of the cap 10 or of the vacuum pump 8. The reduced size of the receptacle 1 makes it possible to conserve the receptacle 1 itself in an ambient medium—such as a refrigerating ambient medium—promoting the effectiveness of the conservation of the cartridge 2 inside the tube 4 which is depressurized and of which a residue of air that it contains preferably has the moisture removed from it.

The tube 4 and the head 5 interact with one another to this end, with the tube 4 accommodating the cartridge 2 and the components of the head 5 being alternatively utilized by the user depending on the various use states of the head 5 to place the interior volume of the tube 4 under negative pressure and/or to hermetically close the tube 4. The receptacle 1—tube 4 and head 5—then form a whole which makes up a device for storing and conserving the cartridge 2 which is prepared by a user of the cartridge 2 who has the task in this case of forming a bead of resin between two adjoining surfaces.

The invention claimed is:

1. A receptacle for storing and conserving a reserve of polymerizable resin, wherein the receptacle is a receptacle for storing and conserving at least one cartridge having a nozzle for dispensing a resin, the receptacle comprising at least:

at least one blind rigid tube of axial extent forming a receiving portion for receiving one said cartridge, one axial end of the tube being open and forming a passage for introducing the at least one cartridge into the at least one blind rigid tube and conversely removing the at least one cartridge from the at least one blind rigid tube, the other axial end of the at least one blind rigid tube being blind and forming a leaktight closure bottom of the tube, and a head for generating negative pressure in and leaktight closure of the at least one blind rigid tube, which head is mounted detachably at the one axial end of the at least one blind rigid tube, wherein the other axial end of the tube is hermetically closed by a base sealed around the leaktight closure bottom of the at least one blind rigid tube, the base having a centering member for axially centering the cartridge inside the at least one blind rigid tube.

2. The receptacle as claimed in claim 1, wherein the head comprises:

a depressurization member for depressurizing the at least one blind rigid tube provided with a first mounting member for leaktight mounting of the head at the one axial open end of the at least one blind rigid tube, a cap for leaktight closure of the receptacle provided with a second mounting member for leaktight mounting on the depressurization member, the cap being mounted detachably on the depressurization member between an active state in which the cap mounted on the depressurization member hermetically closes off the receptacle and an inactive state in which the removed cap allows a detachable vacuum pump belonging to the head to interact with the depressurization member.

3. The receptacle as claimed in claim 2, wherein the first leaktight-mounting member has a ring which forms the depressurization member and a first fixing member for reversible fixing of the ring at the one axial end of the at least one blind rigid tube via a first seal, the depressurization member having a valve accommodated inside the ring, the valve being naturally held in a closed position and being manoeuverable into an open position via the vacuum pump applied against the valve.

4. The receptacle as claimed in claim 3, wherein the second mounting member for leaktight mounting of the cap on the depressurization member is formed by a second fixing member for reversible fixing of the cap at the one axial open end of the ring that faces toward an outside of the receptacle via a second seal.

5. The receptacle as claimed in claim 1, wherein the one axial end of the at least one blind rigid tube is provided with a recessed body sealed around the tube, on which recessed body the head is mounted detachably at the one axial end of the at least one blind rigid tube.

6. The receptacle as claimed in claim 1, wherein a depressurization chamber for depressurizing the at least one blind rigid tube is formed around the cartridge installed inside the at least one blind rigid tube, between a wall of the at least one blind rigid tube and the cartridge held centered inside the at least one blind rigid tube at least via the centering member.

7. The receptacle as claimed in claim 1, wherein the receptacle is equipped with a cover for receiving the nozzle of the cartridge accommodated inside the at least one blind rigid tube, the cover being installed around the nozzle.

8. The receptacle as claimed in claim 7, wherein the cover axially accommodates a sleeve for receiving the nozzle which opens onto an interior volume of the at least one blind rigid tube through a partition for closing the cover at its end facing toward the other axial end of the at least one blind rigid tube, and through a hood which is hermetically sealed on the cover at its an end of it that facing toward the one axial end of the at least one blind rigid tube and which is provided with a centering bushing for axially centering the nozzle inside the cover.

9. The receptacle as claimed in claim 8, wherein the cover axially accommodates a sleeve for receiving the nozzle which opens onto an interior volume of the at least one blind rigid tube through a partition for closing the cover at its end facing toward the other axial end of the tube, and through a hood which is hermetically sealed on the cover at an end of it that facing toward the one axial end of the at least one blind rigid tube and which is provided with a centering bushing for axially centering the nozzle inside the cover and wherein the cover comprises, along an axial extent of it, a perforated peripheral wall, the perforations of which form passages for air between an interior volume of the cover surrounding the sleeve and an outside of the cover toward the depressurization chamber, the interior volume of the cover forming at least one compartment for receiving at least one agent for treating an air contained inside the tube, said at least one treatment agent being conditioned to be permeable to the air.

* * * * *